US005794929A

United States Patent [19]

Curley et al.

[11] Patent Number: 5,794,929

[45] Date of Patent: Aug. 18, 1998

[54] VARIABLE VELOCITY PROFILE DECELLERATION DEVICE

[75] Inventors: Richard Daniel Curley, Dover; Kevin Lauren Cote, Durham, both of N.H.

[73] Assignees: Heidelberger Druckmaschinen AG, Heidelberg, Germany; Heidelberg Harris, Inc., Dover, N.H.

[21] Appl. No.: 601,669

[22] Filed: Feb. 15, 1996

Related U.S. Application Data

[63] Continuation-in-part of Ser. No. 468,894, Jun. 6, 1995, abandoned, which is a continuation of Ser. No. 103,842, Aug. 9, 1993, Pat. No. 5,452,886.

[51] Int. Cl.[6] ..... B65H 5/34

[52] U.S. Cl. ..... 271/270; 271/186; 271/82

[58] Field of Search ..... 271/270, 187, 271/186, 82, 272, 277

[56] References Cited

U.S. PATENT DOCUMENTS

| | | | |
|---|---|---|---|
| 3,884,461 | 5/1975 | Hauser . | |
| 4,132,403 | 1/1979 | Weisbach et al. . | |
| 4,290,595 | 9/1981 | Thunker . | |
| 4,434,979 | 3/1984 | Kobler et al. . | |
| 4,629,175 | 12/1986 | Fischer et al. . | |
| 4,767,112 | 8/1988 | Kobler . | |
| 4,901,996 | 2/1990 | Schlough . | |
| 5,141,221 | 8/1992 | Mack et al. . | |
| 5,277,413 | 1/1994 | Bass . | |
| 5,452,886 | 9/1995 | Curley et al. | 271/270 |
| 5,560,599 | 10/1996 | Curley et al. | 271/270 |

*Primary Examiner*—H. Grant Skaggs
*Attorney, Agent, or Firm*—Kenyon & Kenyon

[57] ABSTRACT

A variable velocity profile deceleration device is provided for gripping a signature from a cutting cylinder, tape system or other transporting device at high speeds. The signatures are positively gripped, decelerated through a smooth velocity profile, and delivered to a further processing device such as a single copy gripper conveyor, or a stacker. The deceleration device includes a plurality of rotary grippers mounted to a drum. The drum rotates about an axis under the control of a drive. The rotary grippers each include an upper roller in rolling engagement with a lower roller at a nip. An independent gripper drive is coupled to each rotary gripper for rotating the upper and lower rollers. A control unit monitors the angular position of the rotary grippers and the rotational speed of the rotating drum, and individually controls each gripper drive to grip a signature exiting the transporting device, slow down the signature in accordance with a selected deceleration profile, and deliver the signature to the processing device. A plurality of deceleration profiles are maintained by the control unit, and a press operator can select the appropriate deceleration profile.

5 Claims, 22 Drawing Sheets

VARIABLE VELOCITY PROFILE DECELLERATION DEVICE

This application is a continuation in part of application Ser. No. 08/468,894, now abandoned, entitled Device for Slowing Down Signatures in a Folding Device, filed Jun. 6, 1995, the specification of which is hereby incorporated by reference. Application Ser. No. 08/468,894, in turn, is a continuation of application Ser. No. 08/103,842, filed Aug. 9, 1993, now U.S. Pat. No. 5,452,886.

BACKGROUND OF THE INVENTION

Fan wheels are commonly used devices for slowing down signatures in a folding machine. Fan wheels comprise a plurality of fan wheel discs defined by a plurality of outwardly projecting curve-shaped fan blades. Fan wheel pockets formed by adjacent blades receive signatures exiting a folding device. The curve shape and jagged surface of the fan blades slow the forward movement of the signatures being deposited in the fan pockets to a complete stop. Once a given fan pocket receiving a signature has turned through approximately 90° the signature is deposited on a delivery system.

A drawback of devices of this nature is that because the signatures enter the fan wheel pockets at such high velocities they are thrust tumultuously against the blades of the fan wheel causing the signatures to tear and otherwise become damaged. Another drawback of these devices is that it is not possible to precisely aim the products towards the bottoms of the fan wheel pockets. The reason for this is that as the signatures come off belts leading to the fan wheel, a number of factors come into play, such as the paper caliper, the number of pages in the signature, the nature of the paper and even the amount of ink thereon, which will all affect the motion of the signature so that, dependent on the cumulative effect of such factors the signature may land neatly on the bottom of the fan wheel pocket or may recoil backwards or catch on the edge of a fan wheel blade. Once a signature is irregularly positioned on the fan wheel, it will be deposited onto the delivery belt irregularly as well and the product stream thereon is likely to contain laterally displaced, unevenly spaced or skewed signatures. This is especially true where large speed reductions, e.g., (5:1) are required.

U.S. Pat. No. 4,629,175 discloses an apparatus intended to overcome some of these drawbacks. The apparatus comprises a number of rows of grippers rotating between a transfer or supply device and a delivery system. The grippers are slowed down by an acceleration/deceleration drive running in the direction of motion from the transport or supply device to the delivery system from approximately the supply speed to approximately the speed of the delivery system and are able to be accelerated up to the speed they were moving at before such deceleration in the following section of their motion. The grippers are mounted to a cylindrical drum rotating at a constant speed, and the rows of grippers decelerated and accelerated by the deceleration/acceleration drive are turned at a speed equal to that of the drum and are mounted so that they may be shifted in relation to the outer face of the drum.

However, a drawback with this device is that the transfer of the signature from the supply device to the deceleration drum can cause distortion misalignment and/or tearing of the signature. Because this transfer is achieved by positioning the deceleration drum so that the gripper rotates into a position in front of the leading edge of the signature being delivered by the supply device, the velocity of the signature being controlled by the supply device must be greater than the tangential velocity of the gripper on the deceleration drum. This causes the signature to gain on the gripper until it has entered the throat of the gripper a desired distance. The gripper then closes and the velocity of the leading edge of the product abruptly changes to match the velocity of the gripper. If the trailing edge of the signature is in the control of the supply device at this time, then distortion of the signature will occur and possible tearing. A further drawback of this device is that it is not capable of achieving high speed reduction ratios as are now required to accommodate today's new high speed printing presses. This device is designed for speed reduction ratios of approximately 3:1. Speed reduction ratios of 5:1 are now being demanded.

SUMMARY OF THE INVENTION

In accordance with the present invention, a variable velocity profile deceleration device is provided for gripping a signature from a cutting cylinder, tape system or other transporting device at high speeds. The signatures are positively gripped, decelerated through a smooth velocity profile, and delivered to a further processing device such as a single copy gripper conveyor, or a stacker.

In accordance with a first embodiment of the present invention, the deceleration device includes a plurality of rotary grippers mounted to a drum. The drum rotates about an axis under the control of a drive. The rotary grippers each include an upper roller in rolling engagement with a lower roller at a nip. An independent gripper drive is coupled to each rotary gripper for rotating the upper and lower rollers. A sensor is provided for detecting the angular position of the rotary grippers with respect to the axis. A control unit monitors the angular position of the rotary grippers and the rotational speed of the rotating drum, and individually controls each gripper drive to grip a signature exiting the transporting device, slow down the signature in accordance with a selected deceleration profile, and deliver the signature to the processing device. In accordance with a further embodiment of the present invention, a plurality of deceleration profiles are maintained by the control unit, and a press operator can select the appropriate deceleration profile.

In accordance with a second embodiment of the present invention, the deceleration device includes a plurality of rotary grippers mounted to a drum. The drum rotates about an axis under the control of a drive. The rotary grippers each include an upper roller in rolling engagement with a lower roller at a nip. A cam is removably mounted within the deceleration device, and each rotary gripper includes a respective cam follower which is coupled to the cam. The outer profile of the cam is selected so that as the cam followers traverse the cam, each respective rotary gripper grips a signature exiting the transporting device, slows down the signature in accordance with a selected deceleration profile, and delivers the signature to the processing device. In accordance with this embodiment, a plurality of cams having different outer profiles can be maintained by the press operator. Since the cam is removably mounted to the deceleration device, the deceleration profile of the deceleration device can be quickly changed by simply replacing the cam with a cam having a different outer profile.

BRIEF DESCRIPTION OF THE DRAWINGS

FIG. 9(*f*) is a graph showing the rotation of the lower roller of FIG. 9*a* as a function of the rotation of the drum of FIG. 9*a*.

FIG. 9(*g*) is a graph showing the rotational speed of the lower roller of FIG. 9*a* as a function of the rotation of the drum of FIG. 9*a*.

DETAILED DESCRIPTION OF THE INVENTION

Figure 1:
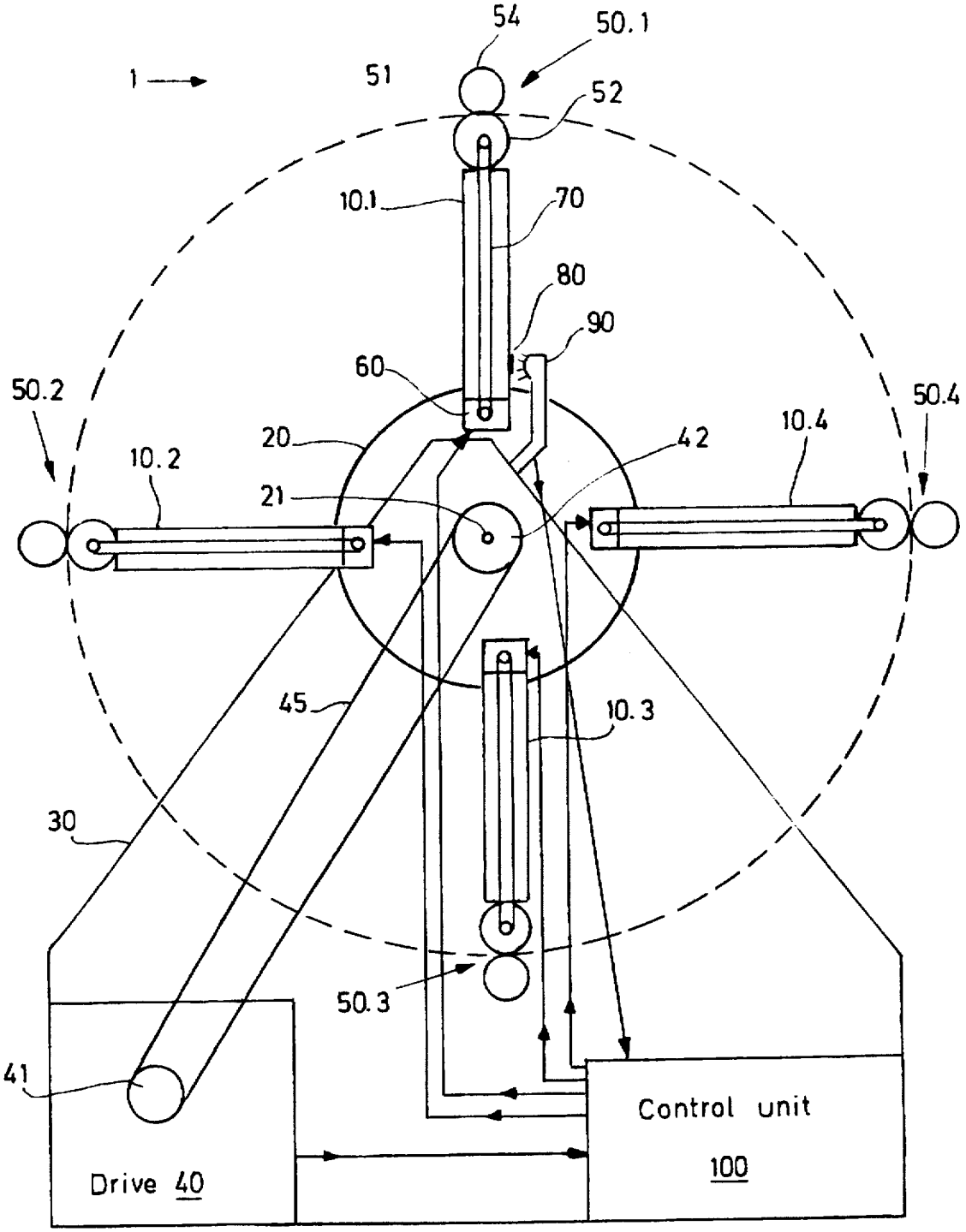
FIG. 1 shows a deceleration device in accordance with a first embodiment of the present invention, including a plurality of rotary grippers mounted to anns which rotate about a central axis.

FIG. 1 shows a deceleration device 1 according to the present invention. A plurality of arms 10.1, 10.2, 10.3, 10.4 are mounted to a drum 20. The drum 20 is rotatably mounted in a frame 30, and is rotated about an axis 21 by a drive 40 via a belt 45. At an outer end of each arm 10, a rotary gripper 50 is mounted.

Each rotary gripper 50 is driven by a gripper drive 60 via a gripper belt 70. A control unit 100 has respective outputs connected to the gripper drives 60, and has a first input connected to the drive 40. The control unit controls the rotational speed of the gripper drives 60 via the outputs, and monitors the rotational speed of the drive 40 via the first input. A target 80 is mounted on one of the arms 10.1 and a sensor 90 is suitably mounted within the deceleration device 1 to detect the target as it passes a selected angular position relative to the axis 21. The control unit 100 has a second input connected to the sensor 90. As the target 80 passes the sensor 90, a trigger signal is transmitted to the control unit.

Figure 2:
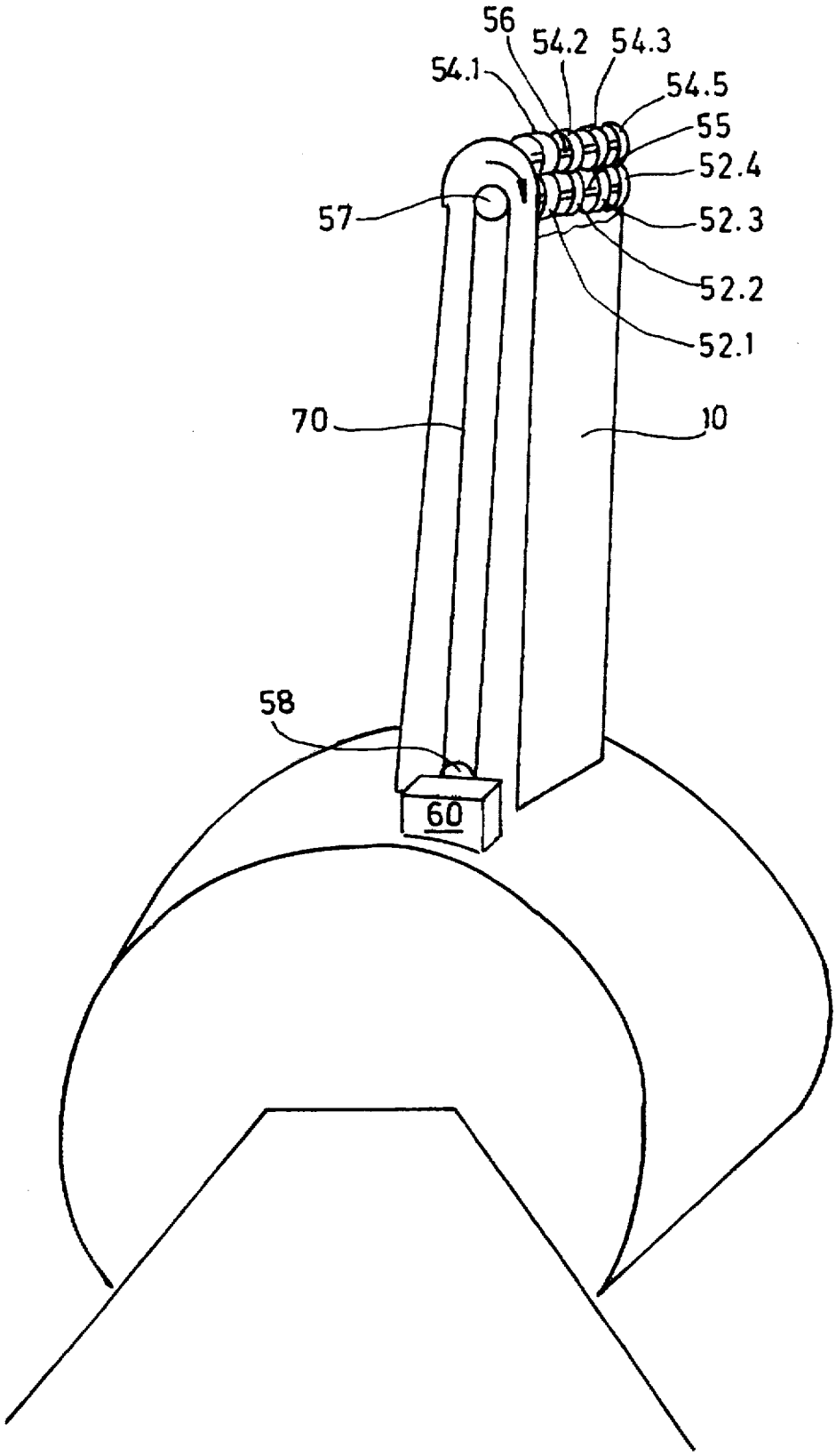
FIG. 2 shows a more detailed view of a rotary gripper and ann of FIG. 1, the rotary gripper including a plurality of upper rollers in rolling engagement with a plurality of lower rollers at a nip.

FIG. 2 shows an arm 10 in more detail. The rotary gripper 50 includes a first plurality of lower rollers 52.1, 52.2, 52.3, 52.4 and a second plurality of upper rollers 54.1, 54.2, 54.3, 54.4. The lower rollers 52 are mounted to a lower axis rod 55, and the upper rollers 54 are mounted to an upper axis rod 56. The lower axis rod 55 is mounted to a gear 57, which is driven by the gripper belt 70, which, in turn, is driven by the gripper drive 60. The lower rollers 52 are in rolling engagement with the upper rollers 54 so that a nip 51 is formed there between.

Upon rotation of the gear 57 in a clockwise direction, the lower rollers 52 rotate clockwise and the upper rollers rotate counterclockwise, and vice versa. The upper rollers 54 can be driven by their rolling contact with the lower rollers 52. Alternatively the upper and lower rollers could be geared together.

The deceleration device 1 (as well as the deceleration devices 1000, 2000, 3000 described below) accepts signatures directly from a cutting cylinder, tape system or other transporting device at high speeds. The signatures are positively gripped and decelerated through a smooth velocity profile. Each signature is shingled and delivered from the device at a slow speed. The exact pitch of each shingled signature is a function of the pitch of the signature entering the device and the speed reduction ratio of the device. To obtain optimum registration and control of the delivered signature product, a positive, gripped to gripper, transfer to a single copy gripper conveyor can be used. Performance of belt delivery, stack or log making, or other conventional systems will be improved due to the improved quality of the product registration delivered from the deceleration device 1.

Figure 3:
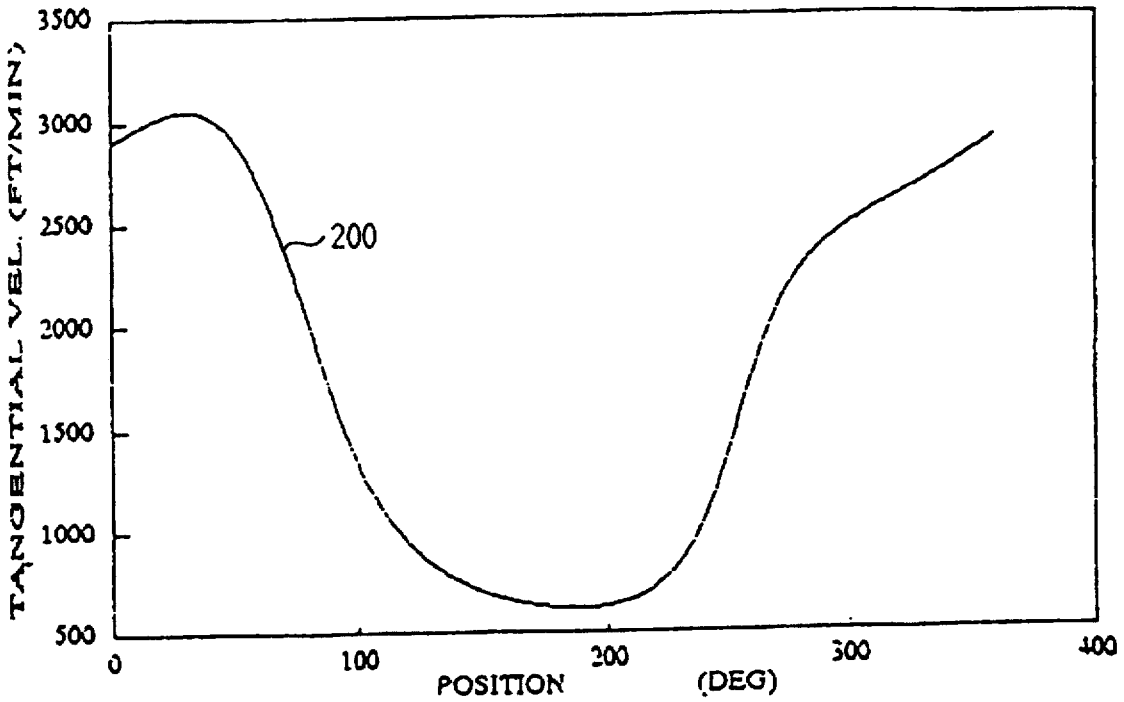
FIG. 3 shows an illustrative desired tangential gripper velocity curve for the deceleration device of FIG. 1.

In accordance with the present invention, a press operator selects a desired velocity profile for the deceleration device 1. FIG. 3 shows an illustrative desired tangential gripper velocity curve 200 in accordance with the present invention. As the tangential velocity reaches 3000 feet per minute, a signature will be received by the rotary gripper 50 at 10 degrees, and then slowed down in accordance with the profile shown until it releases the signature at 180 degrees. A resultant velocity profile for the signature is shown is FIG. 4.

Figure 5:
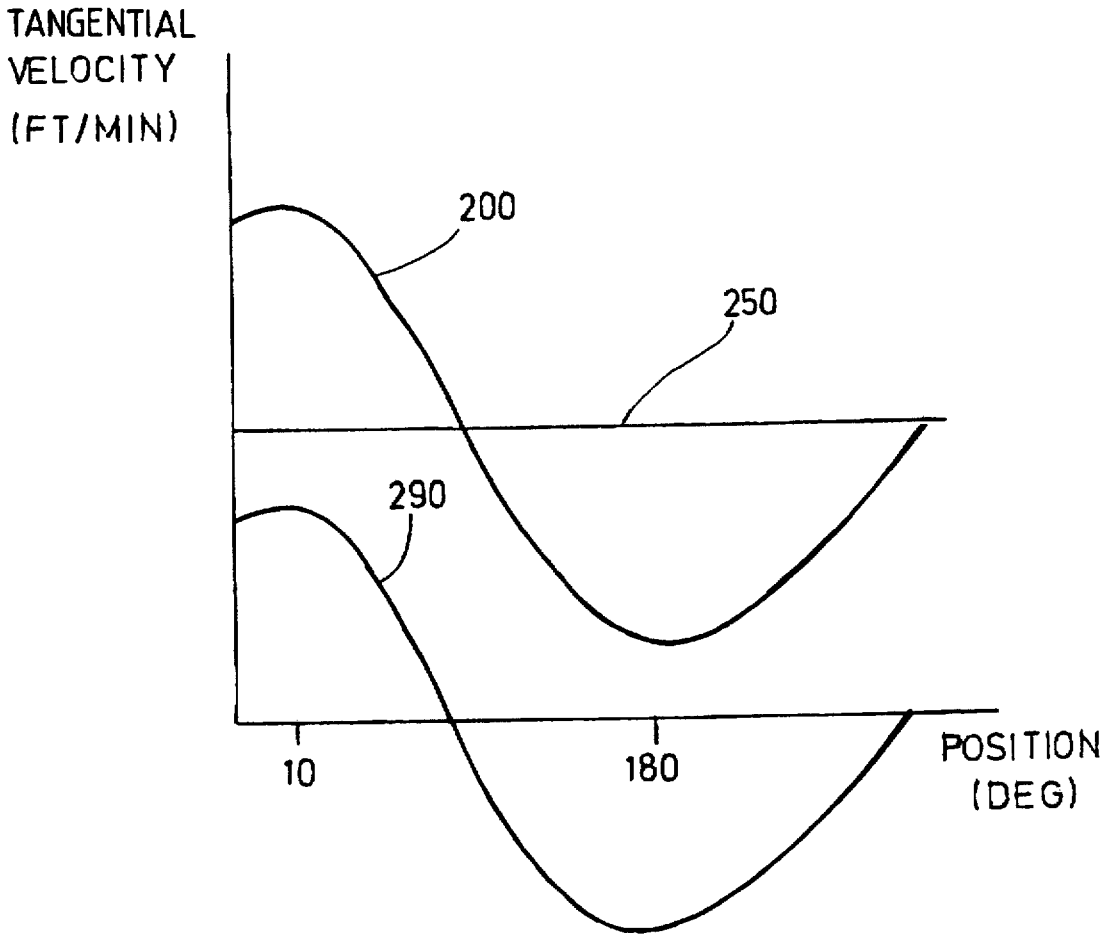
FIG. 5 is a graph of the desired tangential gripper velocity curve of FIG. 3, a tangential velocity curve of the nip about the central axis of the deceleration device, and a desired tangential velocity curve of the lower rollers about their axis.

In order to implement the desired profile, the control unit 100 varies the tangential velocity of the rollers 52, 54 at the nip 51 via the gripper drives 60. For each position on the graph of FIG. 3, the control unit 100 determines a desired tangential nip velocity for the rollers 52, 54. As shown in FIG. 5, the desired tangential nip velocity 290 at each position is equal to the desired tangential gripper velocity 200 at that position minus the tangential velocity 250 of the grippers about the axis 21.

Referring to FIG. 1, the sensor 90 is mounted at a reference position about the axis 21 which will be arbitrarily set at 0 degrees. As the sensor 90 is triggered by the target 80, the control until 100 can uniquely determine the angular position of each arm 10. In the illustrated embodiment, the triggering of the sensor by the target 80 indicates that arm 10.1 is at 0 degrees, arm 10.2 is at 90 degrees, arm 10.3 is at 180 degrees, and arm 10.4 is at 270 degrees. Moreover, since the angular velocity of the arms 10 is known from the drive 40, the control unit 100 can determine a time at which each arm 10.1–10.4 will reach each position along the graph of FIG. 5.

For each position, the control unit 100 will individually control each gripper drive 60 to rotate the rollers 52, 54 at the desired tangential nip velocity 290. The gripper drives 50 are configured as servo motors. An example of a suitable gripper drive are variable speed drives manufactured by SEW. Therefore, upon receiving a desired velocity signal from the control unit 100, the gripper drive will alter its rotational speed to match the desired value.

It should be noted that in those cases where the rotational speed of the drive 40 can be assumed to be equal to a predetermined constant, the control unit need not monitor the speed of the drive 40. In such cases, moreover, the desired tangential nip velocity 290 can be predetermined for the desired velocity 200.

Figure 6:
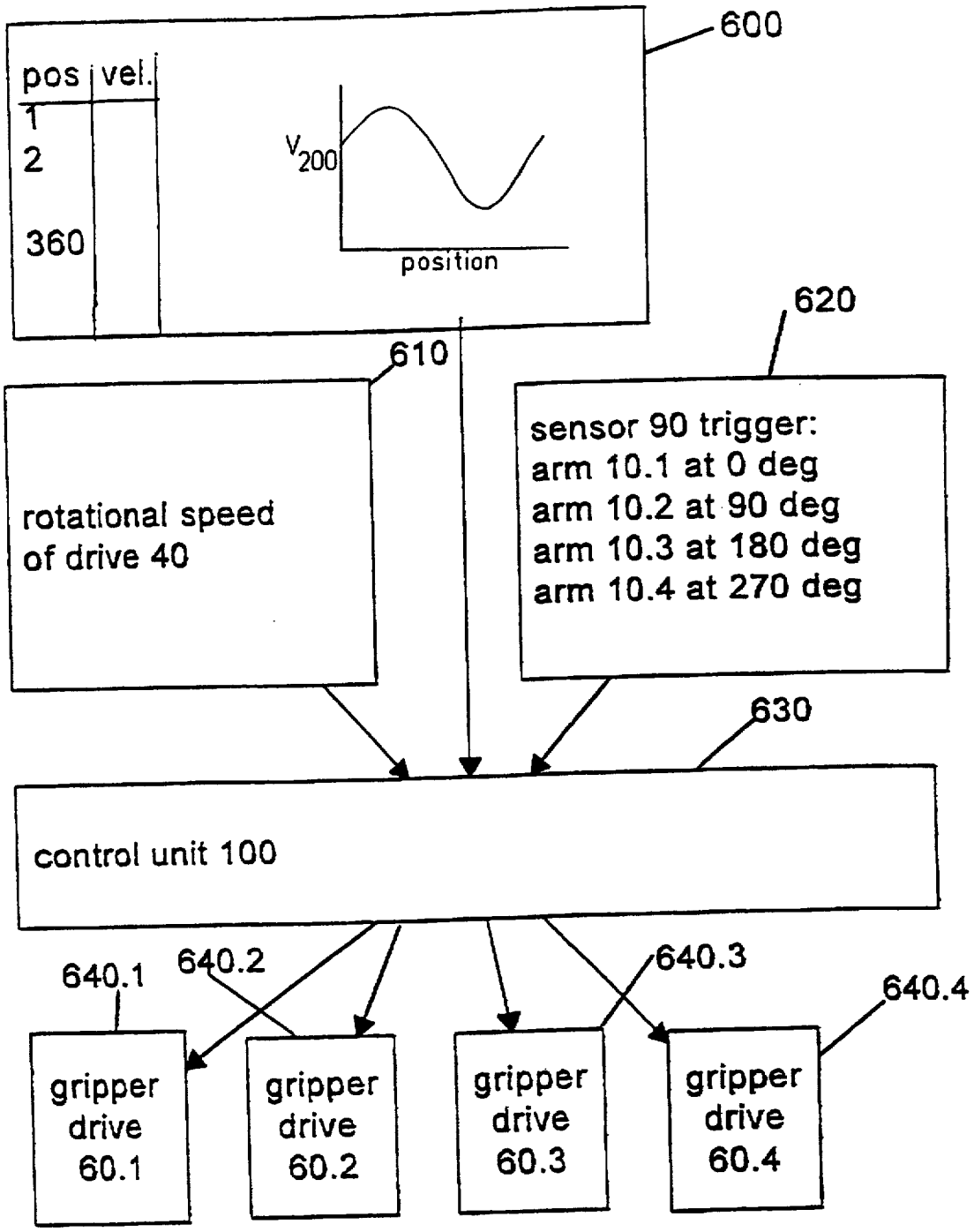
FIG. 6 is an illustrative control flow diagram for the deceleration device of FIG. 1.

FIG. 6 shows the control flow in accordance with an embodiment of the present invention. Blocks 600, 610, 620 represent information available to the control unit 100, e.g. via memory or sensors. As illustrated in block 600, the desired tangential gripper velocity curve 200 of FIG. 3 can be represented as a series of position, velocity coordinates. While the coordinates have been illustrated with a position deviation of one degree, it should be clear that the position deviation cold be smaller or greater. A smaller position deviation, for example ½ degree, would provide a smoother deceleration of the signatures. As illustrated in box 620, when the sensor 90 of FIG. 1 is triggered by the target 80, the arm 10.1 is at the 0 degree position, arm 10.2 is at the 90 degree position, arm 10.3 is at the 180 degree position, and arm 10.4 is at the 270 degree position. As illustrated in box 610, the rotational speed of the drive 40 is also known to the control unit 100. Based upon the information known from boxes 600, 610, 620, the control unit 100 individually controls the gripper drives 60.1–60.4 as illustrated by boxes 640.1–640.4.

Figure 7:
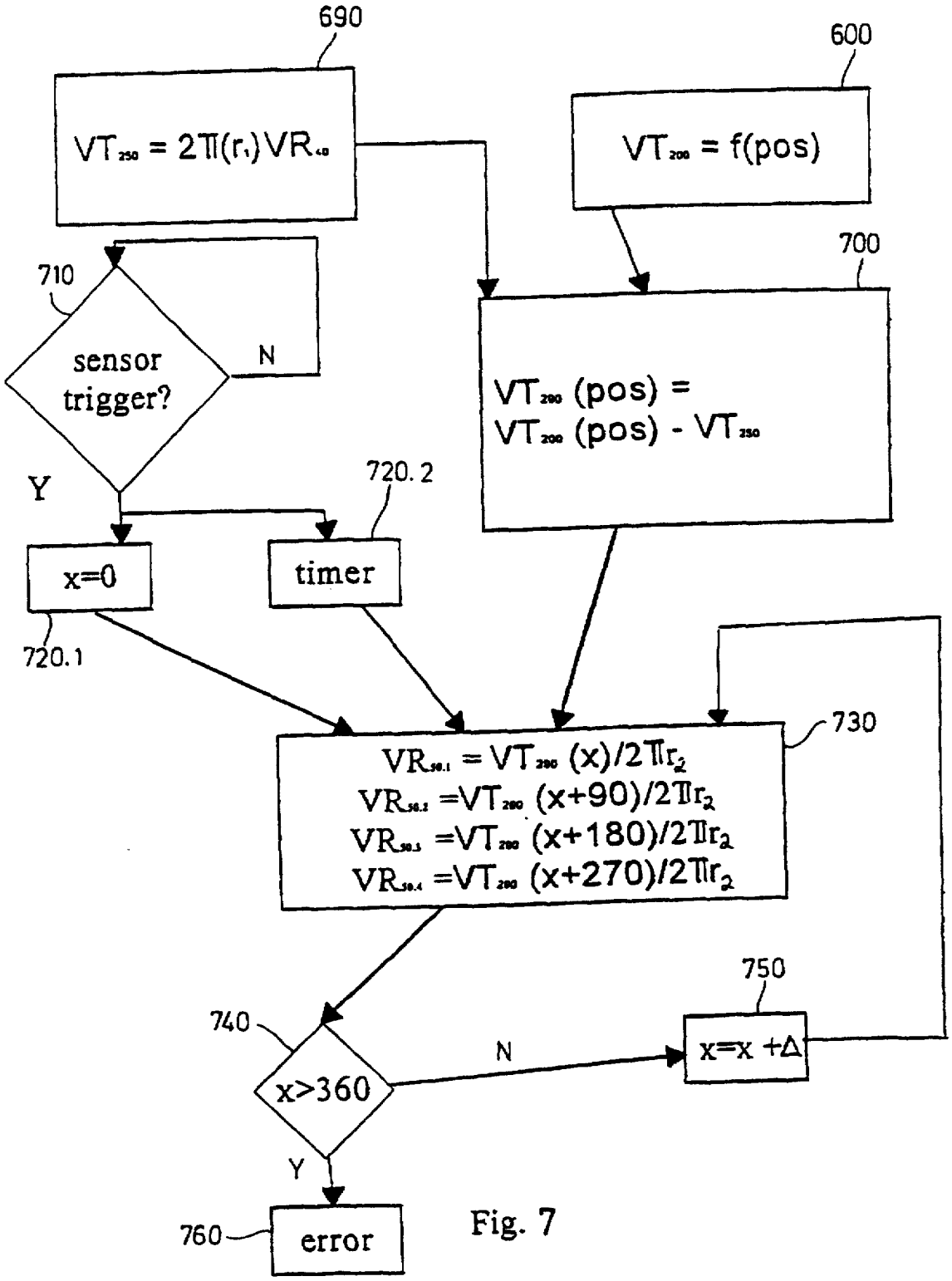
FIG. 7 is an illustrative flow chart for the control unit of the deceleration device of FIG. 1.

FIG. 7 shows an illustrative flow chart for the control unit 100 in accordance with the present invention. At step 600, the desired gripper velocity curve 370 is accessed by the control unit. As explained above with regard to FIG. 6, the curve 270 is defined as a series of position, velocity coordinates. The curve 270 may be manually input by an operator (e.g. via keyboard), or be read from a table of stored values.

At step 690, the control unit 100 periodically monitors the rotational speed of the drive 40, and determines the tangential velocity 250 of the gripper about the axis 21 from the monitored values. For ease of illustration, the drive wheels 41, 42 of FIG. 1 have been assumed to be of equal diameter. Therefore, the tangential velocity 250 ($VT_{250}$) of the grippers about the axis 21 is $VT_{250}=2\Pi(r1)VR_{40}$, where r1 is the radius from the axis 21 to the nip 51, and $VR_{40}$ is the rotational speed of the drive 40.

At step 700, the control unit calculates the desired tangential velocity 290 of the rollers 52 about their axis: $VT_{290}(\text{position})=VT_{200}(\text{position})-VT_{250}$, where $VT_{290}$ (position) is the velocity at each position along the curve 200. In this manner, $VT_{290}$ is known for each position. $VT_{290}$(position) is updated whenever the velocity $VR_{40}$ changes.

At step 710, the control unit monitors the sensor 90. If the control unit receives a trigger signal from the sensor 90, it sets X=0 and sets a timer T for $1/(360*VR_{40})$in step 720.

At step 730, the control unit 100 calculates the desired rotational velocity (VR) for each gripper drive 60.1–60.4. As shown, $VR_{60.1}(x)=VT_{290}(x)/(2\Pi(r2))$, $VR_{60.2}(x)=VT_{290}(x+90)/(2\Pi(r2))$, $VR_{60.3}(x)=VT_{290}(x+180)/(2\Pi(r2))$, and $VR_{60.4}(x)=VT_{290}(x+270)/(2\Pi(r2))$, where r2 is the radius of the rollers 52, and the drive wheels 57, 58 are assumed to be of equal diameter for ease of illustration.

The control unit 100 transmits the desired values $VR_{60.1}$–$VR_{60.4}$ to their respective gripper drives 60.1–60.4. Since the gripper drives 60.1–60.4 are configured as servomotors, each drive 60.1–60.4 will alter its rotational speed to equal its respective desired value $VR_{60.1}$–$VR_{60.4}$.

At step 740, the control unit 100 checks to see if x>360. If x ≯ 360 (N), then x=x+Δ, where Δ is the position deviation (set at 1 degree in this example). The control unit then waits for the timer to expire before repeating step 730. If x>360 (Y), then an error condition is declared and the deceleration device is shut down because a trigger signal should be received every 360 degrees.

Figure 8A:
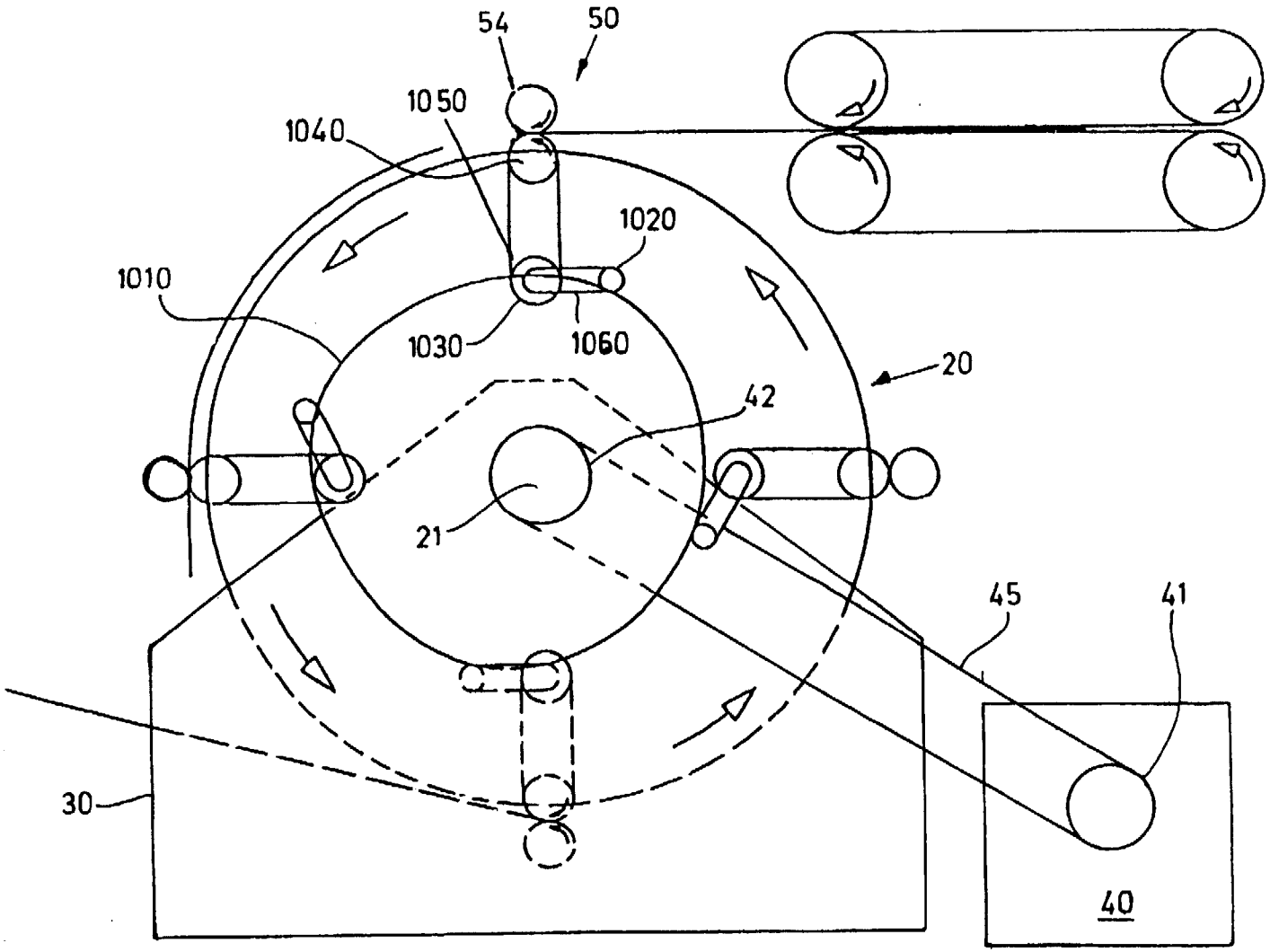
FIGS. 8(*a,b*) show a deceleration device according to a second embodiment of the present invention, including a plurality of rotary grippers mounted to a drum, and connected to a cam.

In accordance with another embodiment of the present invention, the desired tangential velocity 290 of the rollers 52 about their axis is provided by a cam and linkage arrangement. FIG. 8A shows a deceleration device 1000 including a frame 30, and a plurality of rotary grippers 50 mounted to a drum 20. The drum 20 rotates about an axis 21 and is driven by a drive 40 via a belt 45 and drive wheels 41 and 42. The drum 20 could be replaced with the arms 10 of FIG. 1 if desired. Similarly, the embodiment of FIG. 1 could employ a drum instead of the arms 10. The grippers 50 comprise upper rollers 54 and lower rollers 52 as described above with regard to FIG. 2.

In accordance with FIG. 8*a*, a cam 1010 is provided for controlling the rotation of the rollers 52, 54 of the grippers 50. Each gripper 50 includes respective upper and lower rollers 52,54, an upper gripper drive wheel 1040, a belt 1050, a lower gripper drive wheel 1030, a pivot arm 1060, and a cam follower 1020. As the drum 20 rotates about the axis 21, the cam follower 1020 travels along the surface of the cam. As the radius of the cam decreases, the cam follower 1020 moves towards the axis 21, rotating the wheels 1030, 1040 in a clockwise direction. This, in turn, causes the lower roller 52 to rotate clockwise, and the roller 54 to rotate counter-clockwise. Gearing can be provided so that a small rotation of the wheel 1030 will cause a much greater rotation of the rollers 52, 54.

Figure 8B:
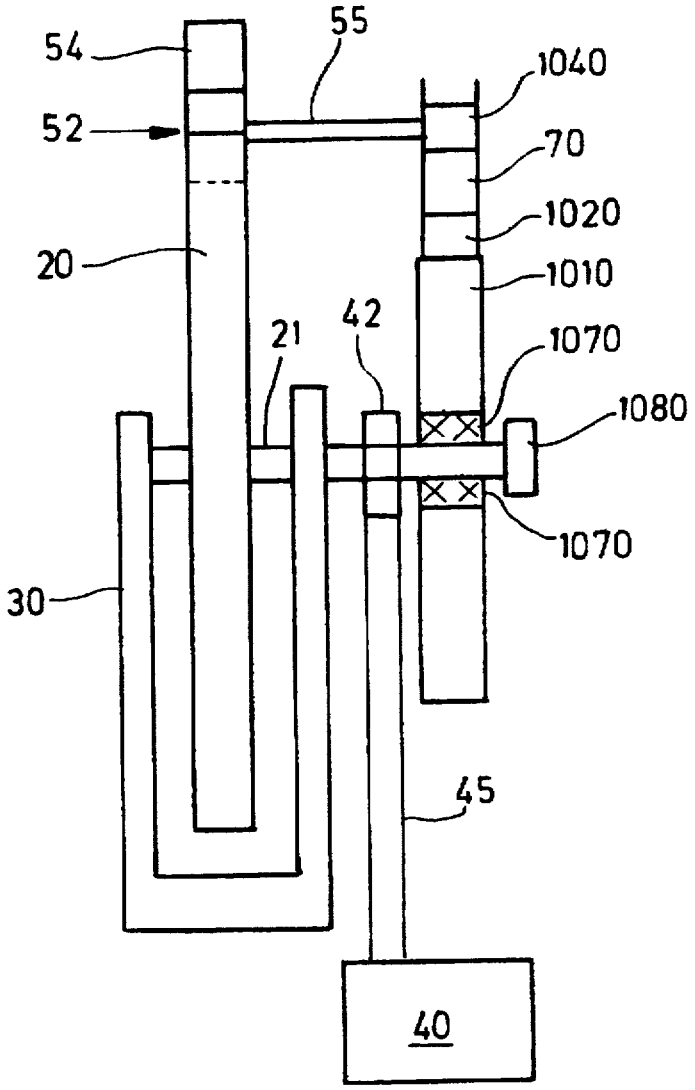

As shown in FIG. 8*b*, the cam 1010 is preferably mounted outside the frame 30 so that it can be easily replaced with a cam of differing profile. The cam 1010 is mounted to the axis 21 via bearings 1070, and secured by a locking mechanism 1080 by conventional techniques so that the cam 1010 remains fixed relative to the rotating drum.

Figure 9A:
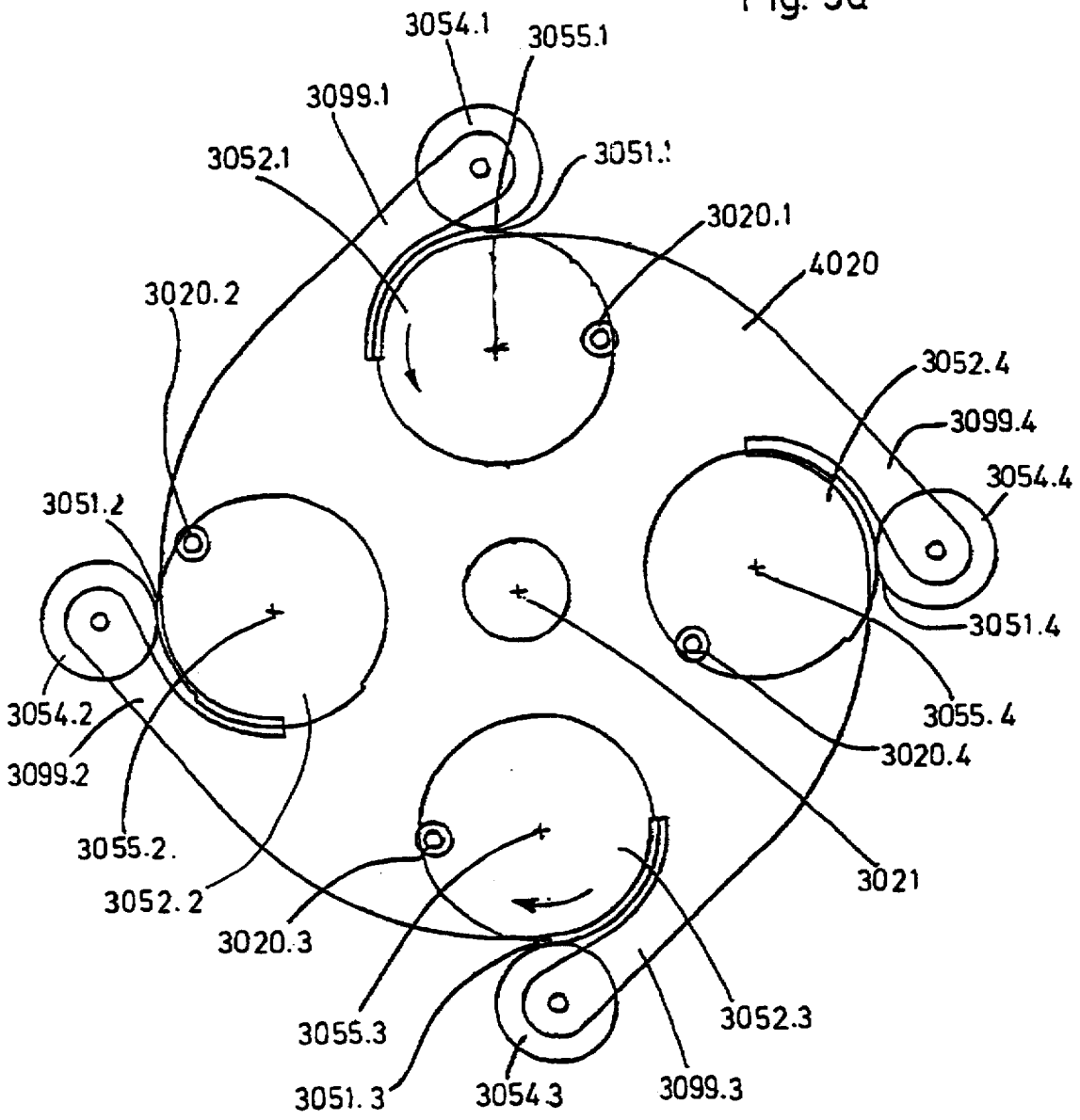
FIGS. 9(*a–e*) show an alternative embodiment of the present invention including a plurality of rotary grippers mounted to a drum, and connected to a cam.

In accordance with an alternative embodiment of the present invention, the belts 1050 can be eliminated, and the rollers 52, 54 controlled directly by the cam. Referring to FIG. 9*a*, a drum 4020 rotates about an axis 3021. Four lower rollers 3052 are rotatably mounted within the drum about respective axes 3055.1–3055.4, and offset 90 degrees from one another. Via arms 3099.1–3099.4, four upper rollers 3054.1–3054.4 are held in rolling engagement with the lower rollers 3052.1–3052.4, forming nips 3051.1–3051.4 therebetween. A respective cam follower 3020.1–3020.4 is mounted on each lower roller 3052.1–3052.4.

Figure 9B:
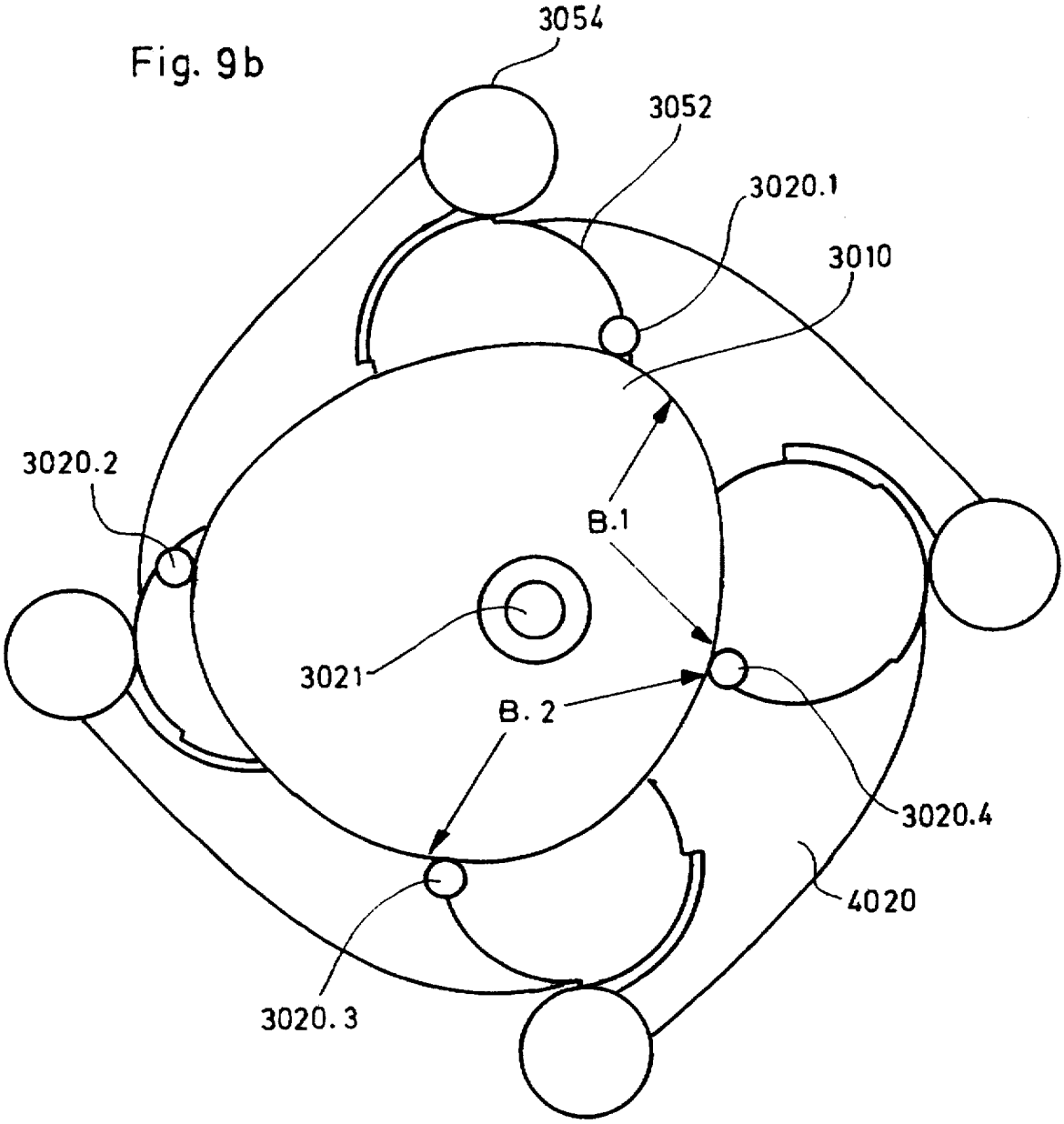
Figure 9C:
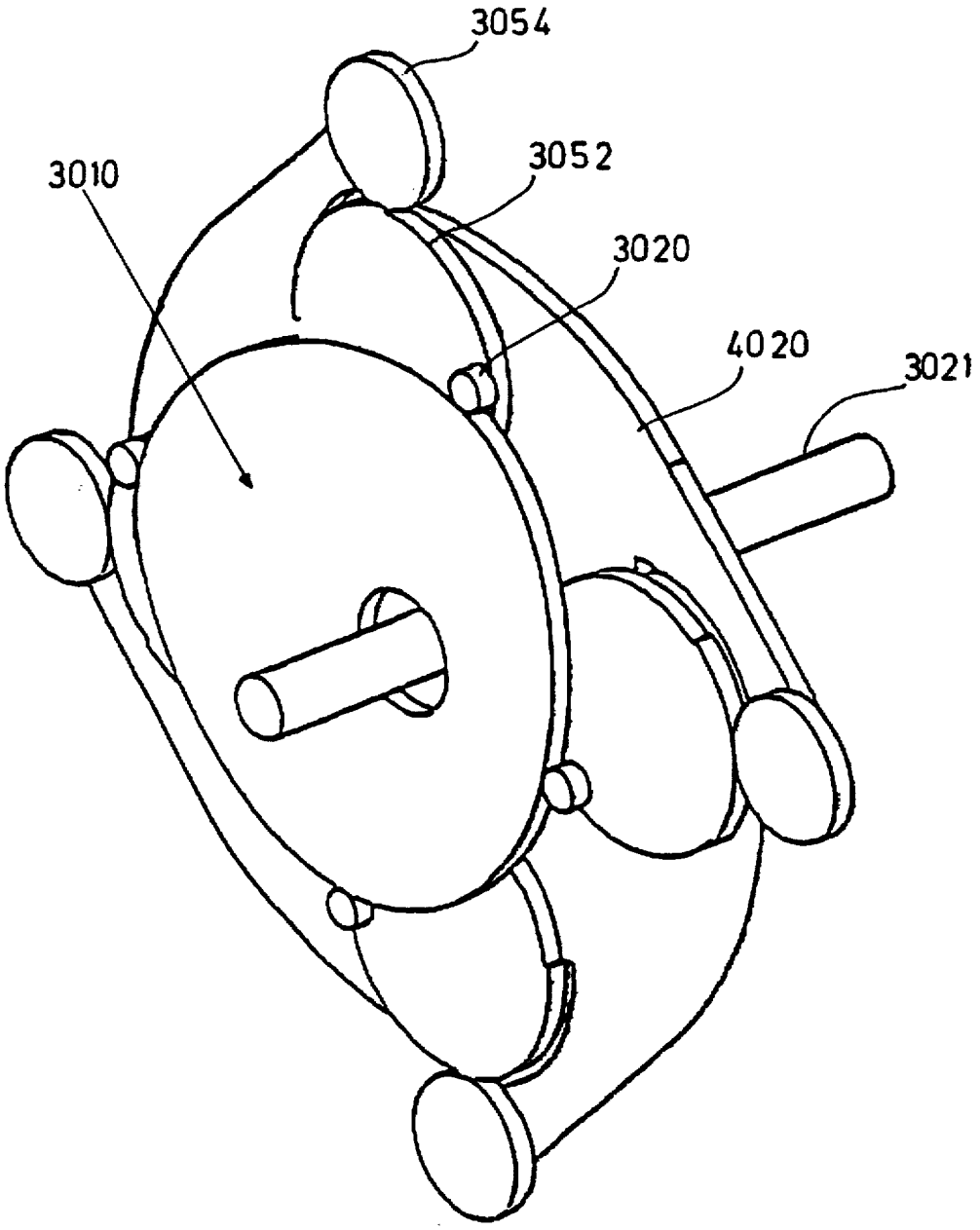
Figure 9D:
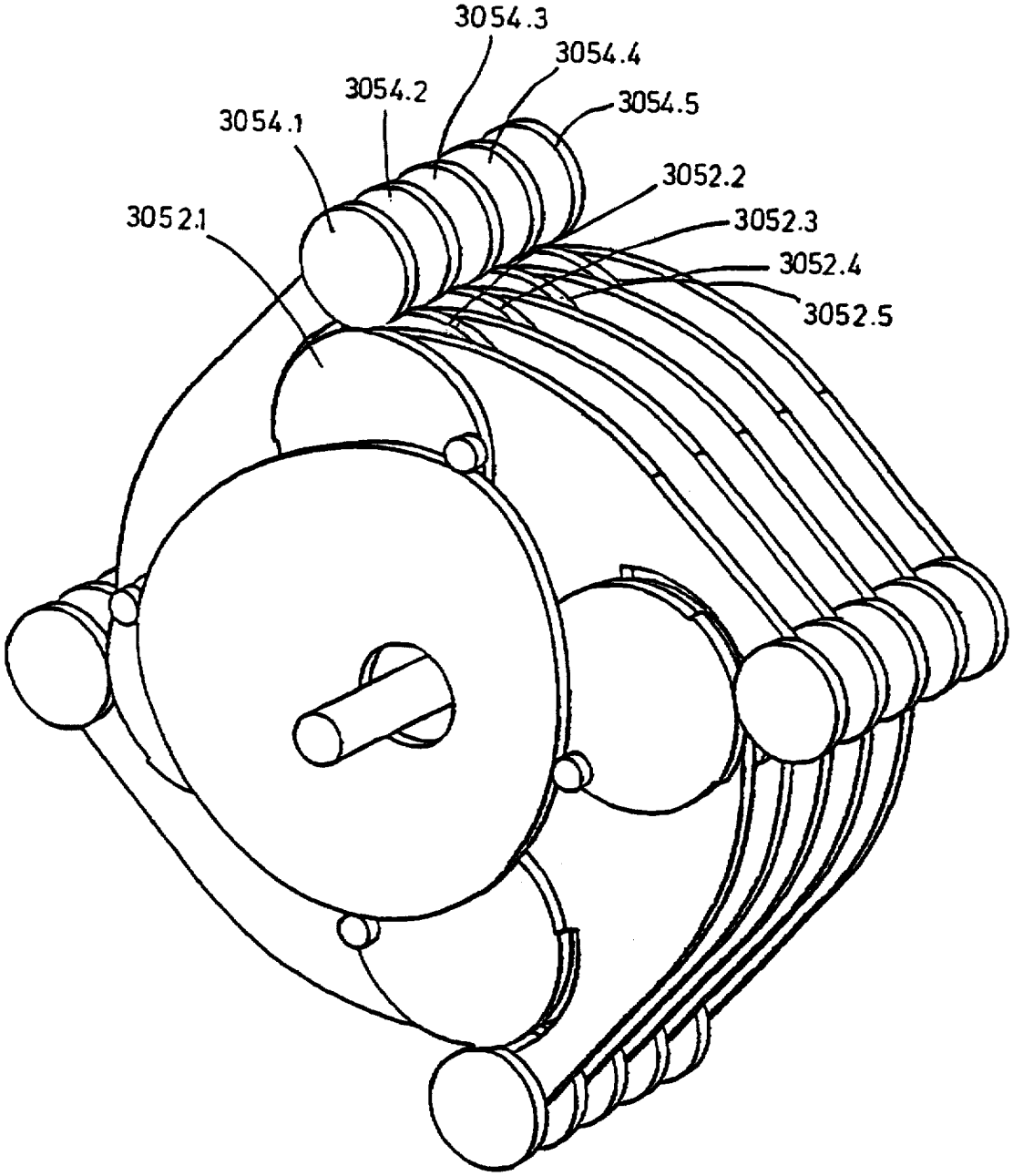
Figure 9E:
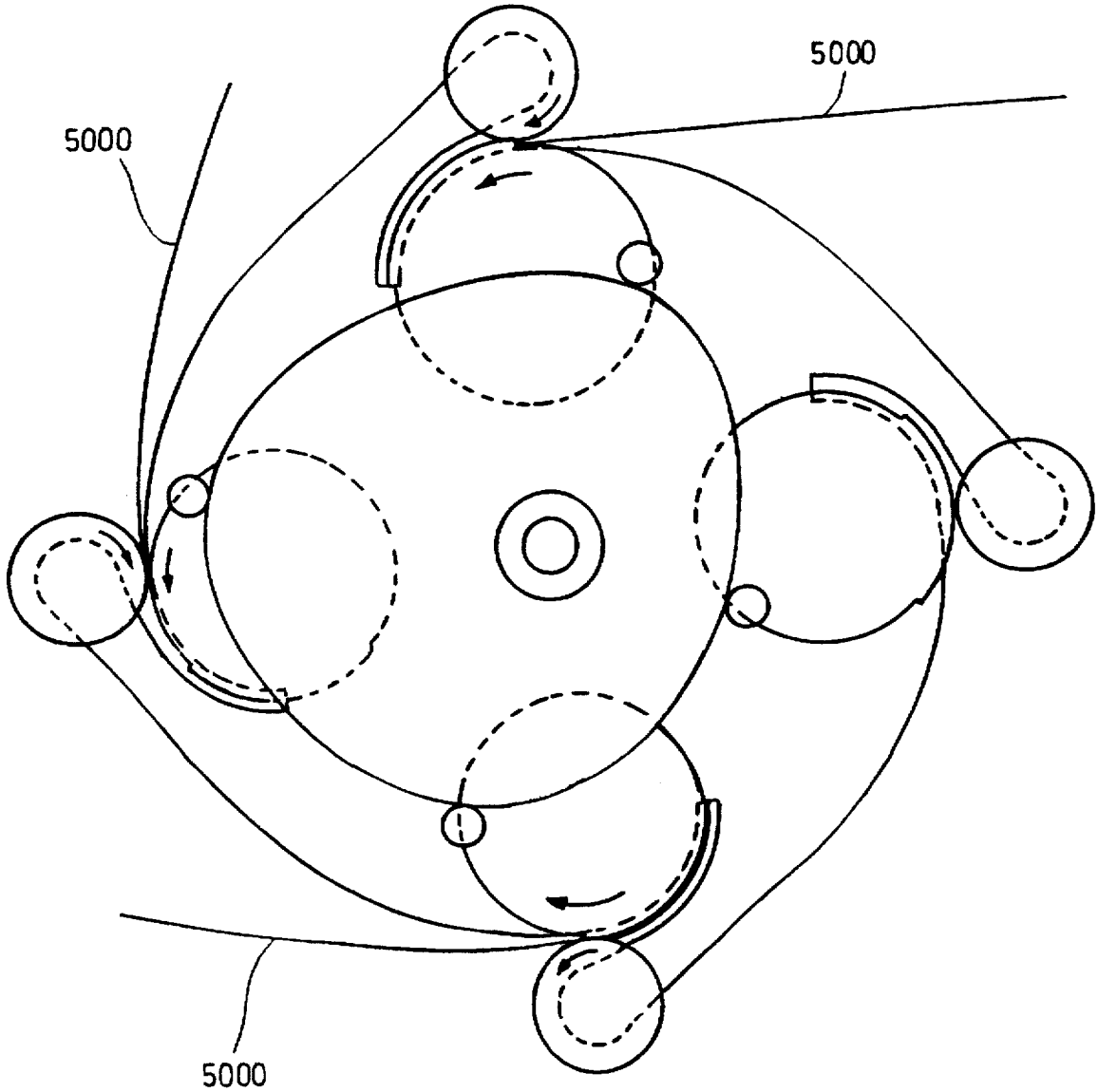

Referring to FIGS. 9*b*,*c*, a cam 3010 is removably mounted on the axis 3021. When mounted on the axis 3021, the cam 3010 remains in a fixed position relative to the axis 3021, and the cam followers 3020.1–3020.4 roll along the outer surface of the cam 3010 as the drum 4020 rotates about the axis 3021. As a cam follower 3020 traverses a portion of the cam 3010 which has an increasing distance from the axis 3021 (e.g. portion B.1), its respective lower roller 3052 rotates counterclockwise, and its respective upper roller rotates clockwise. As the a cam follower traversing a portion of the cam 3010 which has a decreasing distance from the axis 3021 (e.g. portion B.2), its respective lower roller 3052 rotates clockwise, and its respective upper roller rotates counter-clockwise. Moreover, as illustrated in FIG. 9*d*, each roller 3052, 3054, may comprise a plurality of rollers 3052.1–3052.5, 3054.1–3054.4. As shown in FIG. 9*e*, a signature 5000 is received at high speed from an upstream device such as a cutting cylinder as the lower roller 3052 is rotating counter-clockwise and the upper roller 3054 is rotating clockwise. The signature is drawn through the nip 3051 until the shape of the cam 3010 causes the lower roller 3052 and upper roller 3054 to change direction. The signature is then released at a lower tangential velocity.

The shape of the cam 3010, or 1010 can be selected as follows. Referring to FIG. 9*a*, the tangential velocity of the lower roller 3052 about the axis 3021 is $VT_{3052}=VR_{4020}*R1$, where R1is the distance from the axis 3021 to the axis 3055. In this example, R1 is set at 14.25 inches, and $VR_{4020}$ is 28.24 radians/second. The tangential velocity at the nip 3051 is: $VT_{3051}=VT_{3052}+VR_{3051}*R2$, where $VR_{3051}$, is the rotational speed of the roller 3052 about the axis 3055, and R2 is the radius of the roller 3052. The rotational speed of the roller 3052 ($VR_{3051}$) is a function of the shape of the cam 3010 and the position of the cam follower 3020 along the surface of the cam. In this example, R2 is equal to 7 inches. Therefore:

$$VT_{3051}=402.42+VR_{3051}*7.$$

In order to provide a 3:1 deceleration ratio for the deceleration device, we set $VR_{3051}$ to a maximum of 28.24 radians/second and a minimum of −28.24 radians/second. In such a configuration, the deceleration device will receive the signature at its maximum tangential velocity of $VT_{3051}=402.42+(28.24)(7)=600$ inches/second, and will release the signature at its minimum tangential velocity of $VT_{3051}=402.42+(-28.24)(7)=205$ inches/second.

The shape of the cam can then be determined using conventional mathematical techniques as shown below. For the simple cycloidal cam shown in FIG. 9*b*, $VR_{3040}=28.24$ radians/sec, and the total lower nip rotation about the axis 3055 is Π/2 radians (90 degrees) for each 360 degree rotation of the drum 4020 about the axis 30121.

Figure 9F:
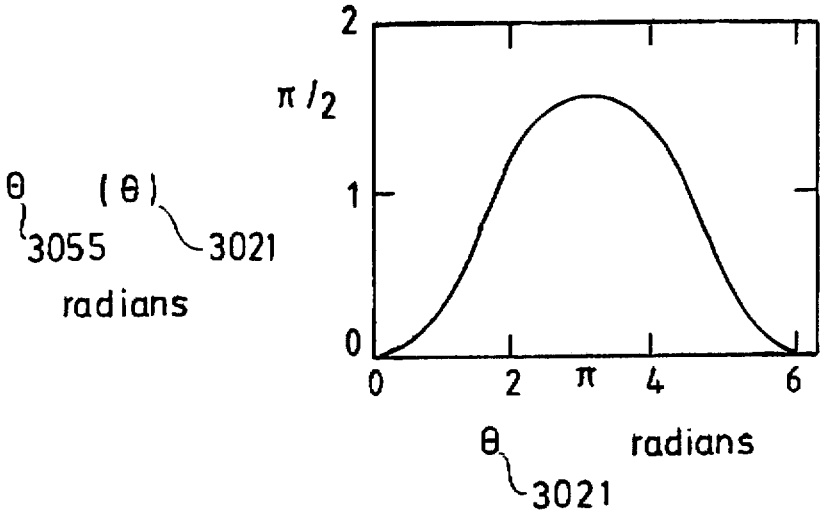
Figure 9G:
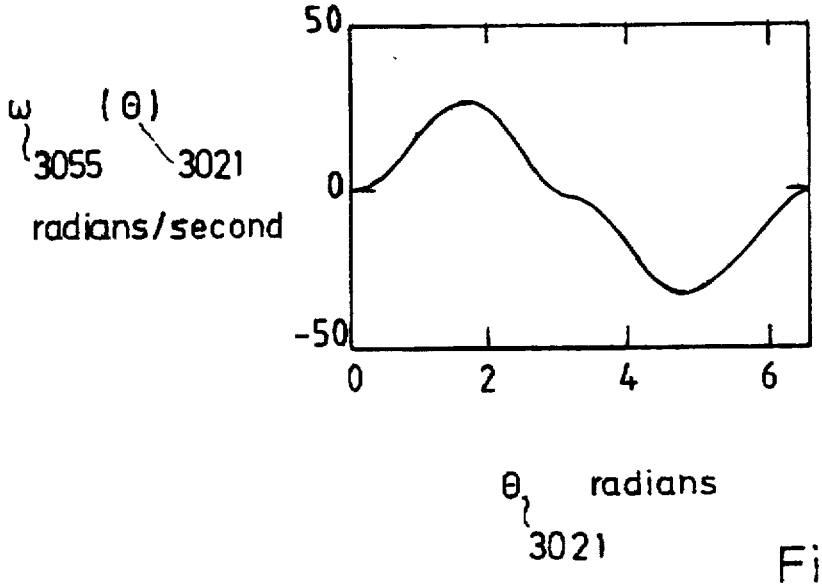

The rotation (in radians) of the lower roller 3052 about the axis 3055 ($\theta_{3055}$) as a function of the rotation of the drum 4020 about the axis 3021 ($\theta_{3021}$) is as follows:

$$\begin{aligned}\theta_{3055}(\theta_{3021}) &= h(\theta_{3021}) * (\theta_{3021}/\beta - 1/(2\Pi) * \sin(2\Pi\theta_{3021}/\beta)),\\ &\quad \text{for } \theta_{3021} < 180 \text{ degrees } (\Pi \text{ radians})\\ &= h(\theta_{3021}) * (\theta_{3021}/\beta - 1/(2\Pi) * \sin(2\Pi\theta_{3021}/\beta)) + \Pi),\\ &\quad \text{for } \theta_{3021} >= 180 \text{ degrees } (2\Pi \text{ radians}),\\ &\quad <360 \text{ degrees } (2\Pi \text{ radians})\end{aligned}$$

where $h(\theta_{3021})$ is the displacement of the cam as a function of the rotation of the drum about the axis 3021, and β equals Π. A plot of $\theta_{3055}(\theta_{3021})$ is shown in FIG. 9(f). As illustrated in FIG. 9(f), $\theta_{3055}(\theta_{3021})$, the rotation of the lower roller 3052 as a function of the rotation of the drum 4020, is a 90 degree (Π/2) positive (counter-clockwise) motion from $\theta_{3021}$ = zero to Π radians (0–180 degrees), and is a 90 degree (Π/2) negative (clockwise) motion from $\theta_{3021}$ = Π to 2 Π radians (180–360 degrees).

The angular velocity of the lower roller 3052 about the axis 3055($\omega_{3055}$) as a function of the rotation of the drum 4020 about the axis 3021 ($\theta_{3021}$) is:

-continued $$\omega_{3055}(\theta_{3021}) = (h(\theta_{3021}) * VR_{3040})/\beta * (1 - \cos(2\Pi\ \theta_{3021}/\beta)).$$

As illustrated in FIG. 9(*g*), $\omega_{3055}$ ($\theta_{3021}$), the angular speed of the lower roller 3052 as a function of the rotation of the drum 4020 rises from 0 to 28.24 radians per second, then decreases from 28.24 radians per second to −28.24 radians per second, and then increases back up to 0 radians per second. Moreover, since $\omega_{3055}$ ($\theta_{3021}$) is directly proportional to h($\theta_{3021}$), the shape of the cam 3010 can be readily determined from the above equations.

Figure 10:
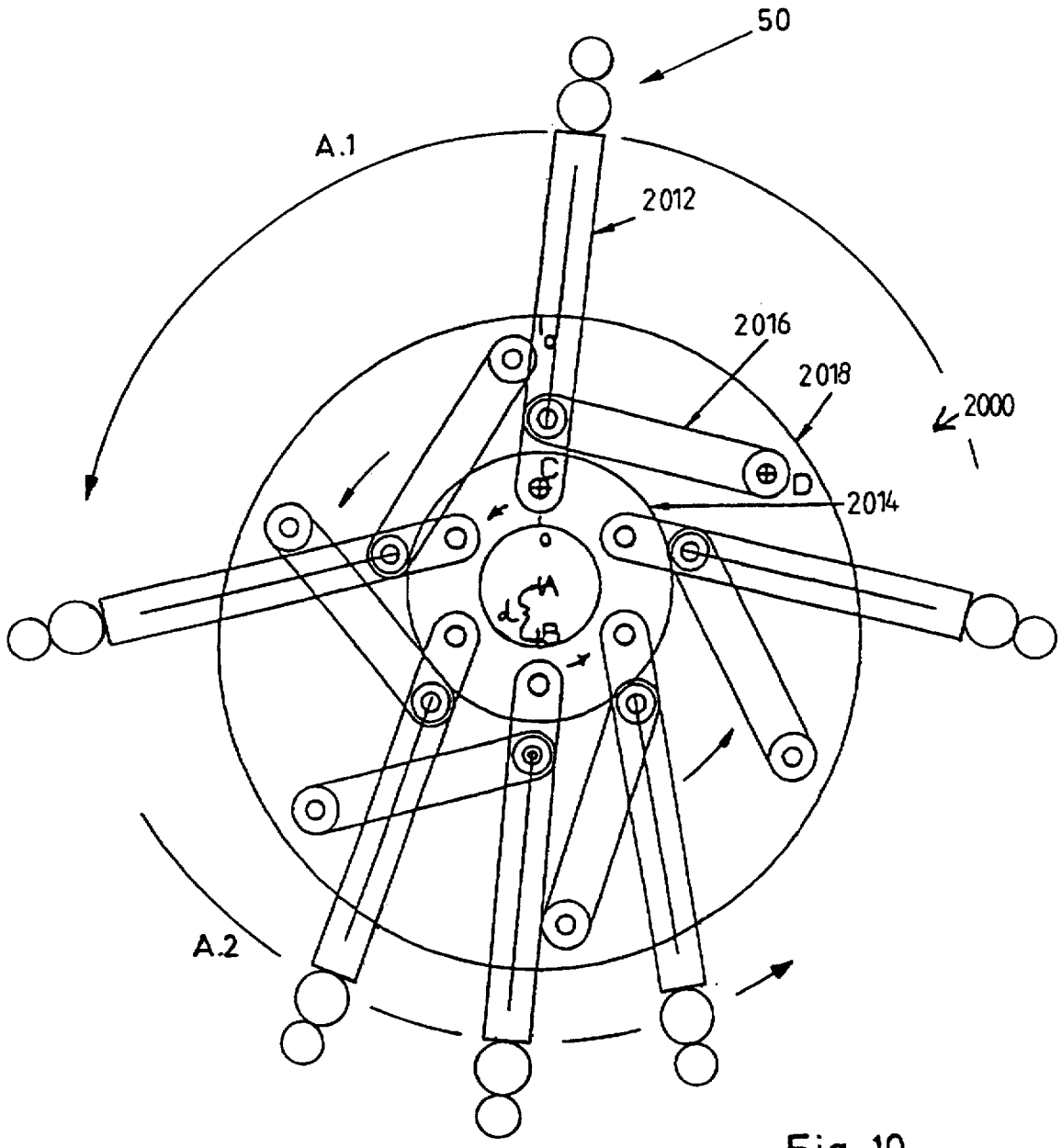
FIG. 10 is a deceleration device according to a third embodiment of the present invention including a plurality of rotary grippers, and a plurality of pivot arms.

FIG. 10 shows a deceleration device according to a third embodiment of the present invention. The deceleration device 2000 includes a plurality of pivot arms 2012 which are connected to a rotating pivot disc 2014 and allowed to pivot independently of each other. The connection points of the pivot arms 2012 to the pivot disc 2014 form a base circle concentric about the center of the pivot disc (point A). A control link 2016 is connected to each pivot arm 2012 at a point radially outward from the pivot point of the pivot arm. The opposite end of each of the control links 2016 is connected to a rotating control disc 2018. The connection points of the control links 2016 to the control disc 2018 form a base circle concentric about the center of the control disc (point B).

The pivot disc 2014 and the control disc 2018 rotate about their own centers at the same speed and in the same direction. The centers of the pivot disc 2014 and the control disc 2018 are fixed and offset from each other, by a distance d, that is the distance between points A and B, as shown in FIG. 10. The greater the offset of the centers, the larger the speed reduction of the pivot arms 2012. Therefore, the deceleration profile of the deceleration device 2000 can be altered by altering the distance d. The can be accomplished by adjusting the position of one or more of the centers A and B.

Figure 12:
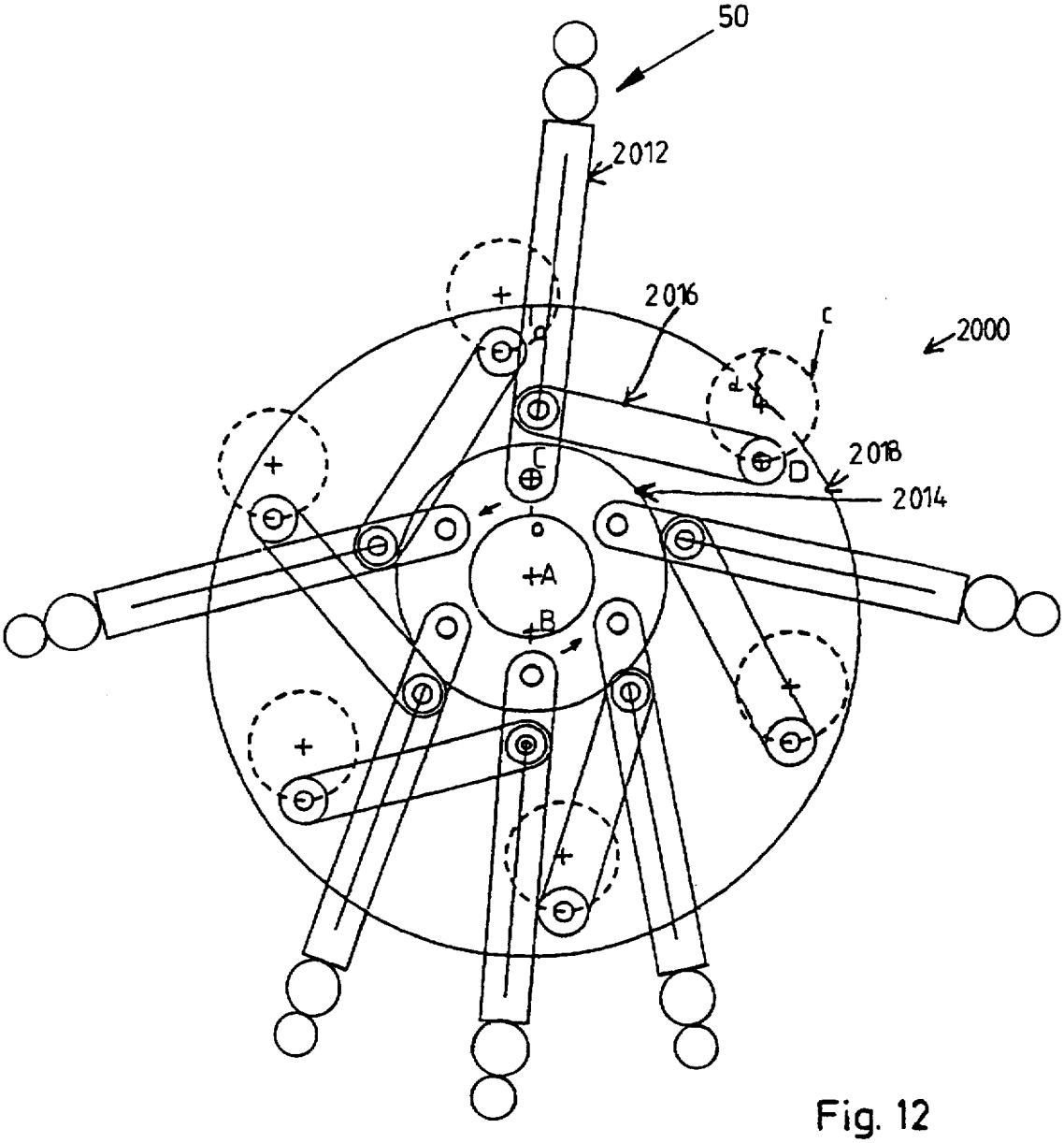
FIG. 12 is shows the path of a point D where a control link attaches to a control disc as it moves relative to a point C where a pivot arm attaches to a pivot disc of FIG. 10.

As the two discs 2014, 2018 rotate, the point at which the control link 2016 attaches to the control disc 2018 (point D) moves relative to the point at which the pivot arm 2012 attaches to the pivot disc 2014 (point C). The path of point D relative to point C is a circle c whose radius is equal to the offset distance d between the center of the pivot disc 2014 and the center of the control disc 18, as shown in FIG. 12. This circular path exists for each pivot arm 2012/control link 2016 pair. Therefore, there exist a number of parallel circles equal to the number of pivot arm 2012/control link 2016 pairs. These parallel circles are positioned equidistant on a base circle about the center of pivot disc 2014 and at a radius that is a function of the control link 2016 length and control disc 2018 size.

Figure 4:
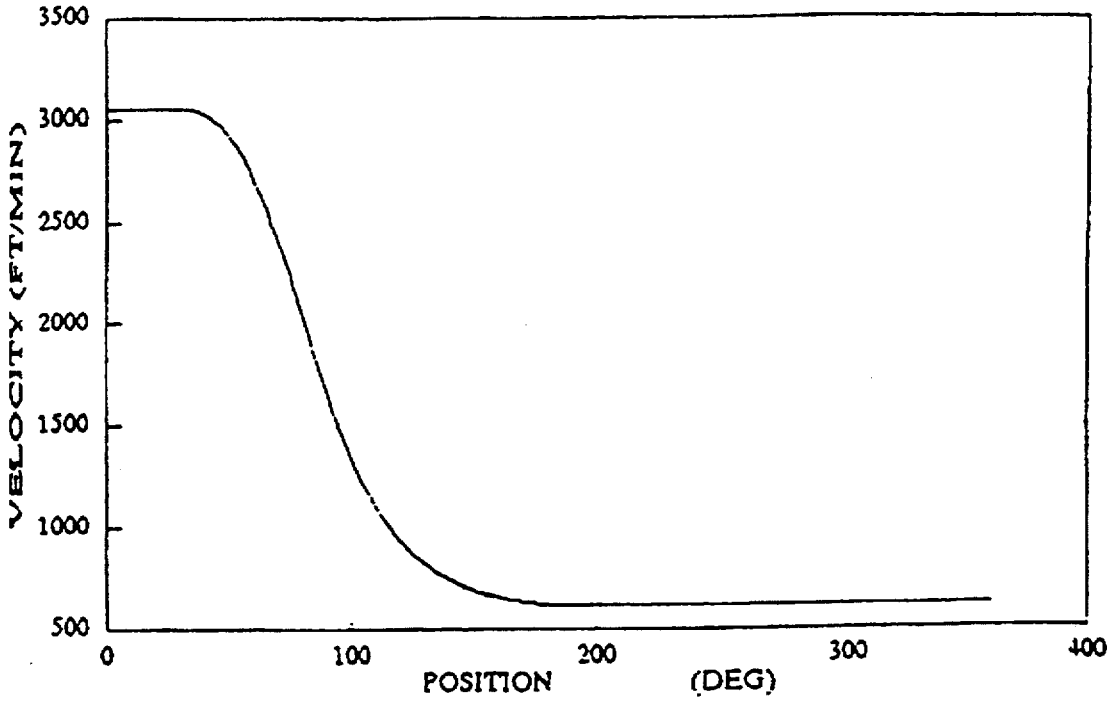
FIG. 4 is a graph of the velocity (in ft/min) of a signature as a function of the position (in degrees) of the deceleration device of FIG. 1.
Figure 13:
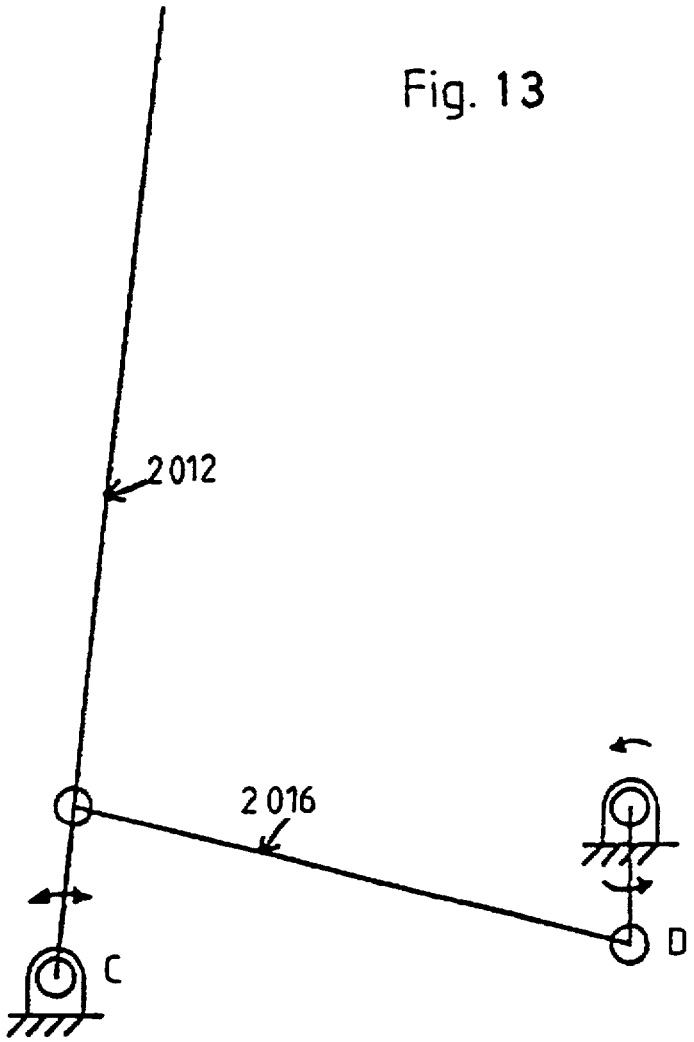
FIG. 13 is a geometric representation of the pivot arm/control link pair shown in FIG. 10 illustrated as a stationary four bar linkage.
Figure 14:
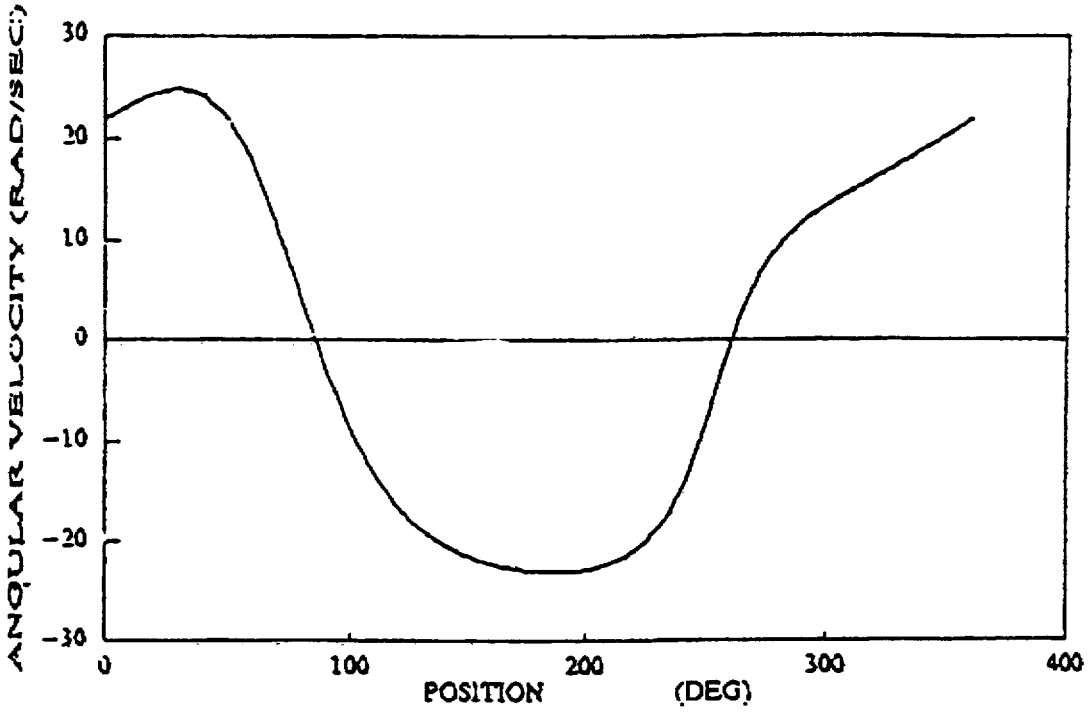
FIG. 14 is a graph of the angular velocity (in rad/sec) of the pivot arm as a function of the position (in degrees) of the pivot disc shown in FIG. 10.
Figure 15:
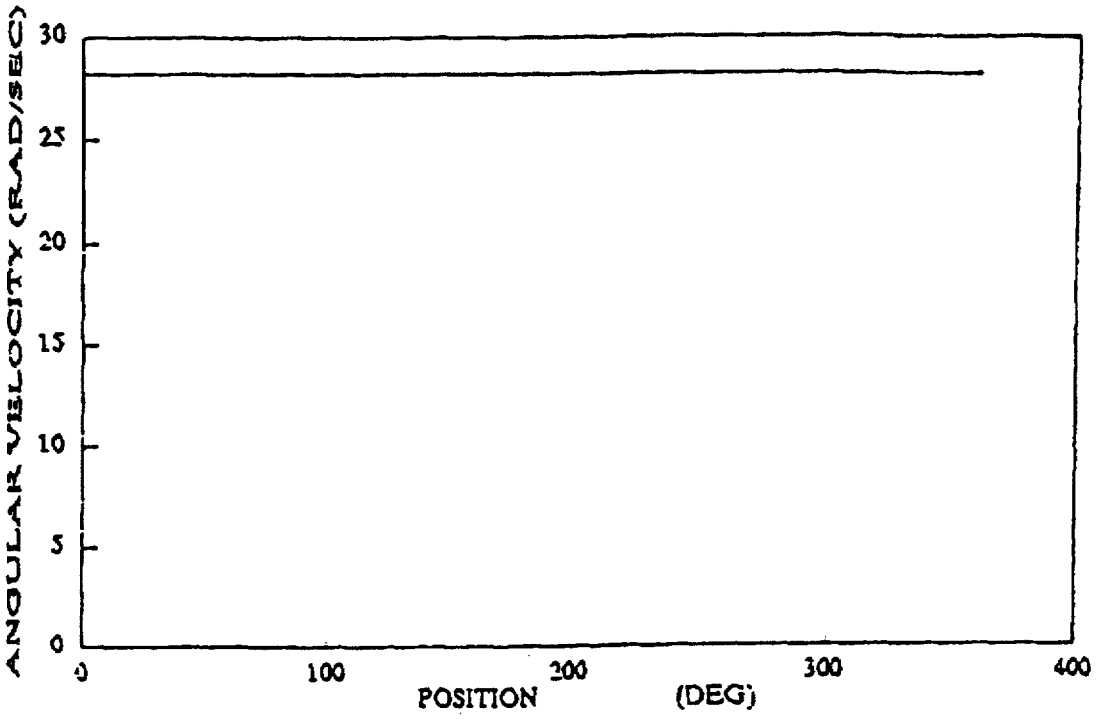
FIG. 15 is a graph of the angular velocity (in rad/sec) of the pivot disc as a function of the position (in degrees) of the control disc shown in FIG. 10.
Figure 16:
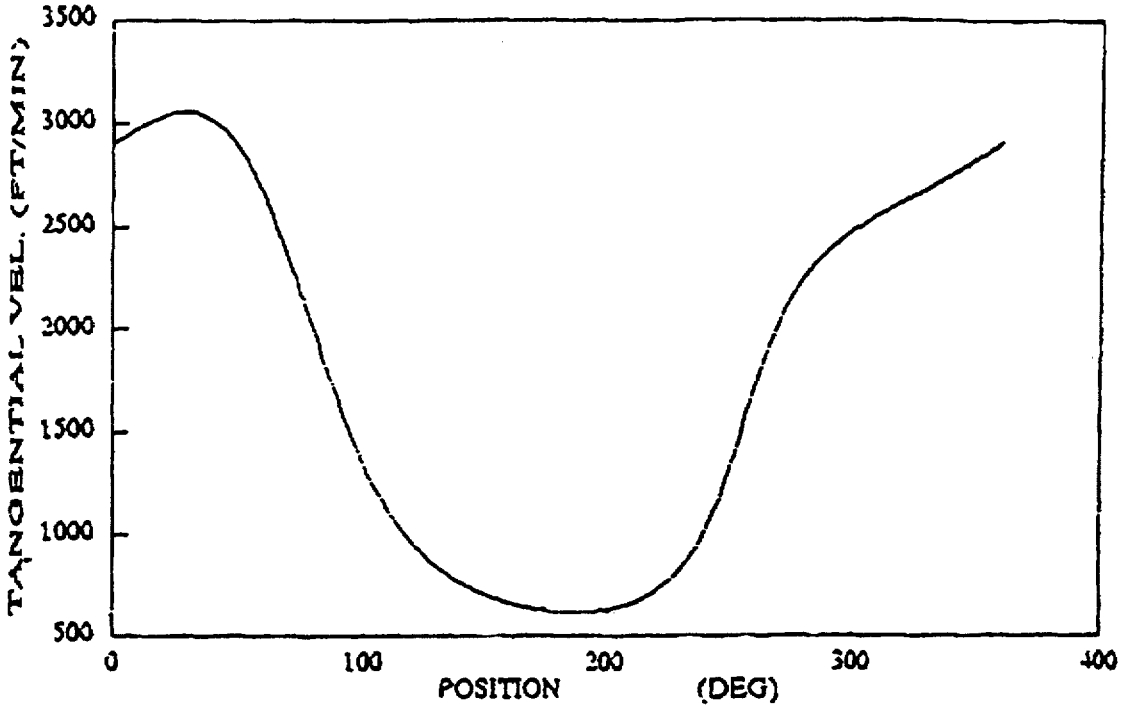
FIG. 16 is a graph of the tangential velocity (in ft/min) of the pivot arm as a function of the position (in degrees) of the deceleration device of FIG. 10.

To achieve a desired tangential gripper velocity profile, e.g. as illustrated in FIG. 3, the pivot arm 2012/control link 2016 geometry can be modeled as a stationary four bar linkage, as shown in FIG. 13. First, the pivot arm's 2012 angular velocity relative to the position of the pivot disc 2014 is analyzed using the four bar linkage model. A graph of this velocity profile is shown in FIG. 14. Once this velocity is determined, the tangential velocity of the end of the pivot arm 2012 due to the rotation of the pivot disc 2014 can be easily calculated. Next, the tangential velocity of the pivot arm 2012 due to the angular rotation of the pivot disc 2014 about the control disc 2018 is calculated. A graph of the angular velocity of the pivot disc 2014 about the control disc 2018 is shown in FIG. 15. The two tangential velocities are then superimposed and the result of the superposition is the true tangential velocity of the pivot arm 2012. A graph of this composi te velocity is shown in FIG. 16. The geometry is preferably set so that the maximum tangential velocity of the pivot arm 2012 is essentially matched to the signature velocity entering the deceleration drum 2000 and the minimum tangential velocity of the pivot arm is essentially matched to the velocity of the delivery system receiving signatures from the drum. FIG. 4 shows a typical signature velocity profile according to the present invention.

Figure 11:
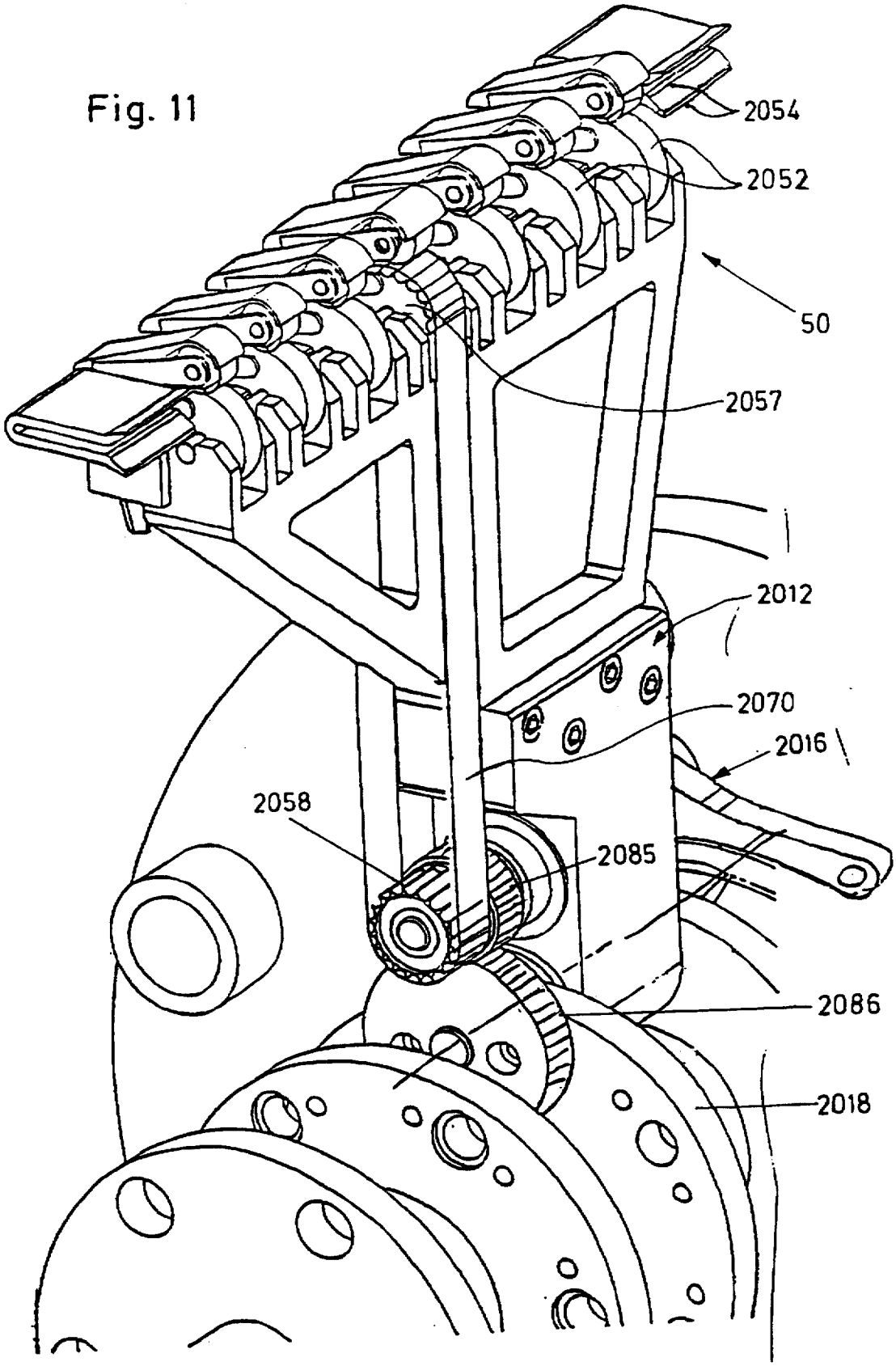
FIG. 11 is a more detailed drawing of the rotary gripper and pivot arm of FIG. 10.

FIG. 11 shows a more detailed embodiment of the deceleration device according to FIG. 10. The rotary gripper 2050 includes upper rollers 2054 and lower rollers 2052 mounted on the pivot arm 2012. The lower rollers 2052 are driven by an upper gripper drive wheel 2057. Since the upper and lower rollers 2052, 2054 are in rolling engagement at a nip 2051, rotation of the lower rollers 2052 also rotates rollers 2054. The upper gripper wheel 2057 is driven by a lower gripper wheel 2058 via belt 2070. The lower gripper wheel 2058, in turn, is driven by a first gear 2085. The first gear 2085 is rotationally mounted to the pivot arm 2012, and is mated with a second gear 2086 which is mounted in a fixed position on the pivot disc 2018. Therefore, as the pivot arm 2012 pivots relative to the control disc 2018, the first gear 2085 rotates, thereby causing a rotation of the upper and lower rollers 2052, 2054. Therefore, referring to FIG. 10, as the arm 2012 pivots across the distance point A.1, the lower rollers 2052 rotate counter-clockwise, and the upper rollers 2054 rotate clockwise to receive the signature. Then, as the arm 2012 pivots across the distance point A.2, the lower rollers 2052 rotate clockwise, and the upper rollers 2054 rotate counter-clockwise to release the signature. The amount of rotation of the lower rollers 2052 for a given angular movement of the pivot arm 2010 is a function of the radius of the gear 2085, and the radius of the drive wheel 2057.

What is claimed is:

1. A variable profile deceleration device, comprising:

a drum rotatably mounted on a first axis;

a drive for rotating the drum;

a plurality of rotary grippers mounted to the drum, each rotary gripper including an upper roller mounted on a second axis and a lower roller mounted on a third axis;

a respective gripper drive corresponding to each rotary gripper, each gripper drive rotating the upper and lower rollers of a respective rotary gripper;

a control unit having a respective output coupled to each gripper drive for controlling the rotation of the lower and upper rollers of the rotary gripper corresponding to the respective gripper drive.

2. A variable profile deceleration device, comprising:

a drum rotatably mounted on a first axis;

a drive for rotating the drum;

a plurality of rotary grippers mounted to the drum, each rotary gripper including an upper roller mounted on a second axis and a lower roller mounted on a third axis;

a respective gripper drive corresponding to each rotary gripper, each gripper drive rotating the upper and lower rollers of a respective rotary gripper; and a control unit coupled to each gripper drive for controlling the rotation of the lower and upper rollers of the rotary gripper corresponding to the respective gripper drive.

3. The variable profile deceleration device as recited in claim 2 wherein the control unit comprises a cam removably mounted on the deceleration device and a plurality of cam followers in rolling engagement with the cam, each cam follower being coupled to a respective rotary gripper.

4. The variable profile deceleration device as recited in claim 3 wherein the cam has a non-concentric profile.

5. The variable profile deceleration device as recited in claim 1 wherein the control unit comprises a control disk, a center of the rotating drum and a center of the control disk being offset from one another, and a control link connected to each gripper, an opposite end of each control link being connected to the control disk.

* * * * *